US005490554A

United States Patent [19]

Moritz

[11] Patent Number: 5,490,554

[45] Date of Patent: Feb. 13, 1996

[54] TEEMING ARRANGEMENT FOR ALUMINUM CONTINUOUS CASTING APPARATUS

[75] Inventor: C. J. Moritz, Bonn, Germany

[73] Assignee: Vaw Aluminium AG, Bonn, Germany

[21] Appl. No.: 271,890

[22] Filed: Jul. 5, 1994

[30] Foreign Application Priority Data

Jul. 5, 1993 [DE] Germany ..... 43 22 316.8

[51] Int. Cl.[6] ..... B22D 41/50; B22D 11/10; B22D 11/18; B67D 5/37

[52] U.S. Cl. ..... 164/437; 164/413; 164/488; 222/594

[58] Field of Search ..... 164/437, 337, 164/453, 454, 449.1, 450.1, 450.2, 450.3, 450.4, 450.5, 413, 488, 438, 439; 222/601, 602, 594, 596

[56] References Cited

U.S. PATENT DOCUMENTS

| | | | |
|---|---|---|---|
| 4,523,624 | 6/1985 | Dantzig et al. | 164/413 |
| 5,205,343 | 4/1993 | Streubel et al. | 164/337 |
| 5,339,885 | 8/1994 | Sinden et al. | 164/450.4 |

FOREIGN PATENT DOCUMENTS 45-8408 3/1970 Japan .

45-36111 11/1970 Japan .

*Primary Examiner*—P. Austin Bradley
*Assistant Examiner*—Randy Herrick
*Attorney, Agent, or Firm*—Darby & Darby

[57] ABSTRACT

A teeming arrangement for a continuous casting apparatus comprises a tundish, a casting nozzle which projects from the bottom of the tundish, and a stopper rod for regulating flow through the casting nozzle. The nozzle has an inlet end and an outlet end and narrows progressively from each of these ends to the middle of the nozzle. The distance from the middle of the nozzle to either end is at least 7 cm. The stopper rod is movable between a closed position in which it seals the middle of the nozzle and an open position in which the nozzle is unobstructed. In the open position, the stopper rod and the nozzle define an annular gap, and the gap has a section which extends from the inlet end of the nozzle partway to the middle and narrows in a direction from the inlet end towards the outlet end. During casting, molten material is discharged from a bath in the tundish via the nozzle and forms a molten pool in a mold. The height of the bath is maintained at 5 cm or more and the nozzle is immersed in the pool to a depth of at least 2 cm. The tip of the stopper rod is held at a distance of 2 cm or more from the outlet end of the nozzle.

14 Claims, 9 Drawing Sheets

TEEMING ARRANGEMENT FOR ALUMINUM CONTINUOUS CASTING APPARATUS

FIELD OF THE INVENTION

The invention relates to continuous casting.

BACKGROUND OF THE INVENTION

An arrangement for teeming molten aluminum-containing material in a continuous casting apparatus generally includes a tundish, a casting nozzle which is mounted on the tundish and a stopper rod for regulating the flow of molten material through the casting nozzle. The arrangement can also include a control system for controlling the depth of penetration of the stopper rod into the casting nozzle within predetermined limits.

Regulation of the flow of molten material using nozzles and stopper rods is disclosed in various publications. For example, the Deutschen Gesellschaft fur Metallkunde e.V. organized a symposium entitled "Stranggiessen-Schmelzen-Giessen-Uberwachen" (Continuous Casting-Melting-Casting-Monitoring) in which bath level regulation using the eddy principle was discussed. The lectures presented at the symposium were published in 1986 and page 331 of the text illustrates a control system containing a nozzle and a stopper rod. The nozzle is fixed to the bottom of a tundish and the lower end of the nozzle projects into a mold.

Under certain circumstances, the flow velocity of the aluminum-containing melt through the casting nozzle can change with a resultant change in the static pressure. When the flow velocity of the melt is very high, a relatively large subatmospheric pressure is generated an the nozzle inlet or outlet. Oxide and dirt particles from the surface of the bath in the tundish and/or from the surface of the pool in the mold are then sucked into the melt and adversely affect the quality of the continuously cast billet or strand.

SUMMARY OF THE INVENTION

It is an object of the invention to provide a teeming arrangement which allows the subatmospheric pressure at a nozzle inlet and/or a nozzle outlet to be reduced.

Another object of the invention is to provide a teeming arrangement which enables the flow characteristics in a casting nozzle to be improved.

An additional object of the invention is to provide a teeming method which makes it possible to reduce eddy current formation in a molten bath.

The preceding objects, as well as others which will become apparent as the description proceeds, are achieved by the invention.

One aspect of the invention resides in a teeming arrangement for a continuous casting apparatus, particularly an apparatus for aluminum-containing materials. The arrangement comprises a temporary holding vessel for a molten substance, a tubular member or nozzle for discharging the molten substance from the vessel, and a valve member movable between a first position in which the nozzle is open and a second position in which the nozzle is closed. The nozzle has an inlet end with a first end face, an outlet end with a second end face, and a location between the end faces at which the cross section of the nozzle is a minimum. The distance between this location and each of the end faces is at least 7 cm. Furthermore, the nozzle and the valve member define a gap in the first or open position of the valve member, and the gap has an upstream section which extends from the first end face for a predetermined distance along the nozzle and narrows in downstream direction.

The valve member has an end surface which is designed to face the outlet end of the nozzle and it is preferred for this end surface to be spaced from the second or outlet end face of the nozzle by at least 2 cm in the open position of the valve member. The valve member may be constructed so that it seals the location of minimum cross section of the nozzle in the second or closed position of the valve member.

It has been found that sucking of oxide and dirt particles from the surface of a molten bath can be reduced or eliminated by imparting a special configuration to the inner contour of a discharge nozzle for the bath material and by maintaining specific immersion depths in a molten pool of the discharged material. Moreover, care should be exercised to have an adequate bath depth.

In accordance with one embodiment of the invention, the subatmospheric pressure generated at the outlet of a discharge nozzle is initially minimized. The depth of immersion of the discharge nozzle in a molten pool of the discharged material is thereupon adjusted so that a molten column high enough to compensate for the residual subatmospheric pressure is formed in the discharge nozzle. The height of the molten column should be at least 2 cm.

The nozzle contour according to the invention is preferably such that the cross section of the nozzle is a minimum in the middle of the nozzle and the highest flow velocity is obtained in the middle of the nozzle. Due to the shape of the nozzle, pulling away of a stream of molten material from the wall of the nozzle, which effectively reduces the flow cross section, can be avoided. Flow thus occurs uniformly over the entire cross section of the nozzle so that optimal volumetric flow is achieved.

In a conventional tundish, different flow characteristics are obtained depending upon which side of the nozzle is first impinged by the molten material flowing in the tundish. Under certain circumstances, this leads to a nonuniform distribution of the molten stream over the inner wall of the nozzle with the result that very high flow velocities are obtained at some locations of the nozzle whereas no flow exists at other locations. This condition affects not only the uniformity of the flow but also the input and output characteristics of the nozzle.

In summary, some of the important concepts of the invention are as follows:

1. The configuring of a nozzle so that the subatmospheric pressures at the inlet and outlet are low.
2. The configuring of a nozzle in such a manner that flow is uniform over the cross section of the nozzle and the stream does not pull away from the nozzle at any location thereof.
3. Throttling the stream in the central region of the nozzle so that the flow energy is reduced and virtually no turbulence occurs at the inlet and outlet ends of the nozzle.

BRIEF DESCRIPTION OF THE DRAWINGS

Additional features and advantages of the invention will become apparent from the following detailed description of certain specific embodiments when read in conjunction with the accompanying drawings.

DESCRIPTION OF PREFERRED EMBODIMENTS

Figure 1:
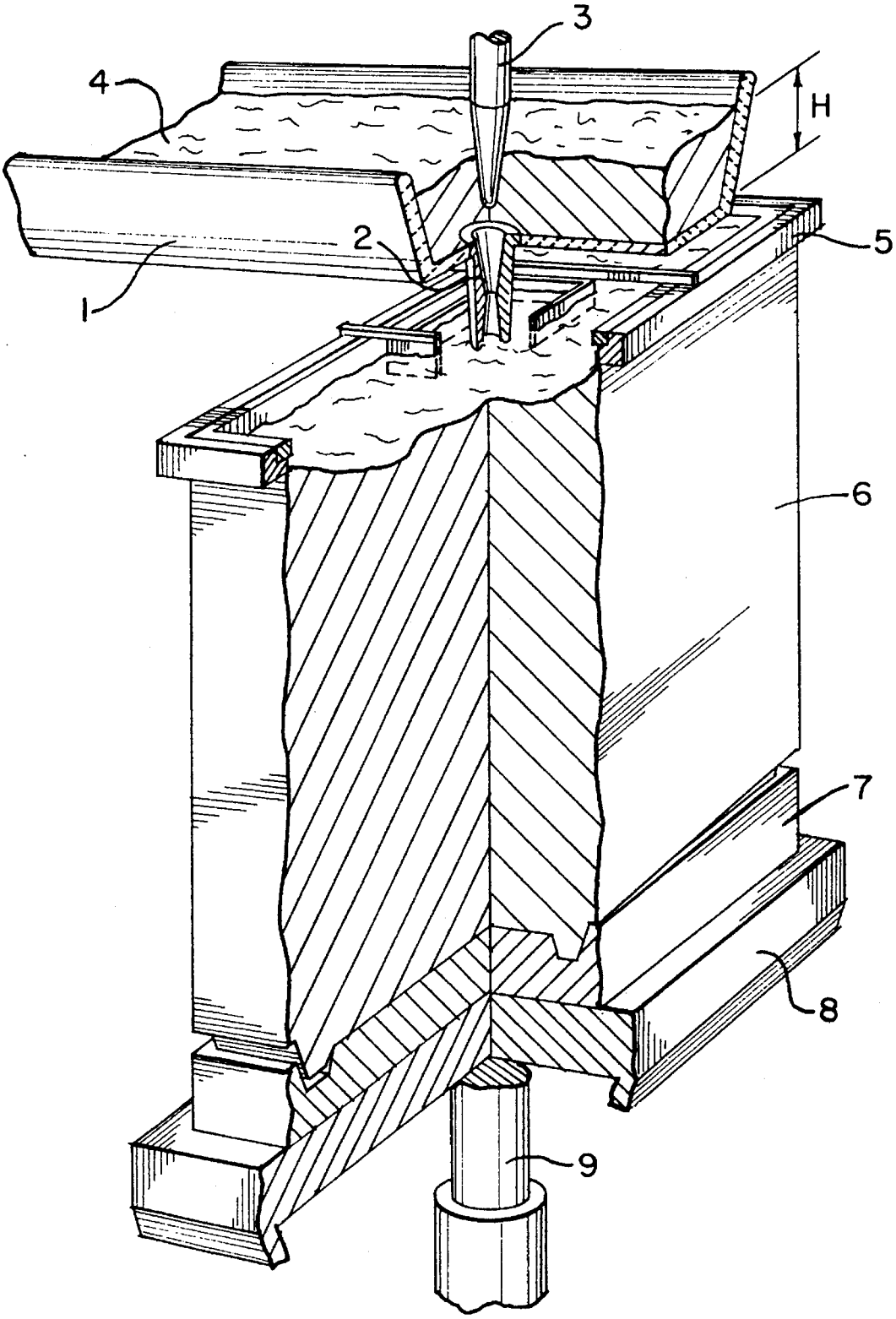
FIG. 1 is a partly sectional perspective view of a teeming arrangement according to the invention as applied to an apparatus for the continuous casting of aluminum-containing materials.

FIG. 1 shows an apparatus for the continuous casting of aluminum-containing materials. The apparatus comprises a continuous casting mold 5 as well as an arrangement in accordance with the invention for teeming material from a molten supply bath 4 into the mold 5. The teeming arrangement includes a tundish or temporary holding vessel 1 for the molten supply bath 4, a casting nozzle or tubular member 2 which is mounted on the bottom of the tundish 1 and serves to discharge the molten material from the tundish 1 into the mold 5, and a stopper rod or valve member 3 for regulating flow of the molten material into the nozzle 2. The molten material flows from the tundish 1 into the mold 5 via the nozzle 2. In the mold 5, the molten material is converted into a billet 6 which establishes a connection to a starting block 7 mounted on a casting table 8. The billet 6 is withdrawn from the mold 5 by lowering the casting table 8 through the agency of a withdrawal device 9.

Figure 2:
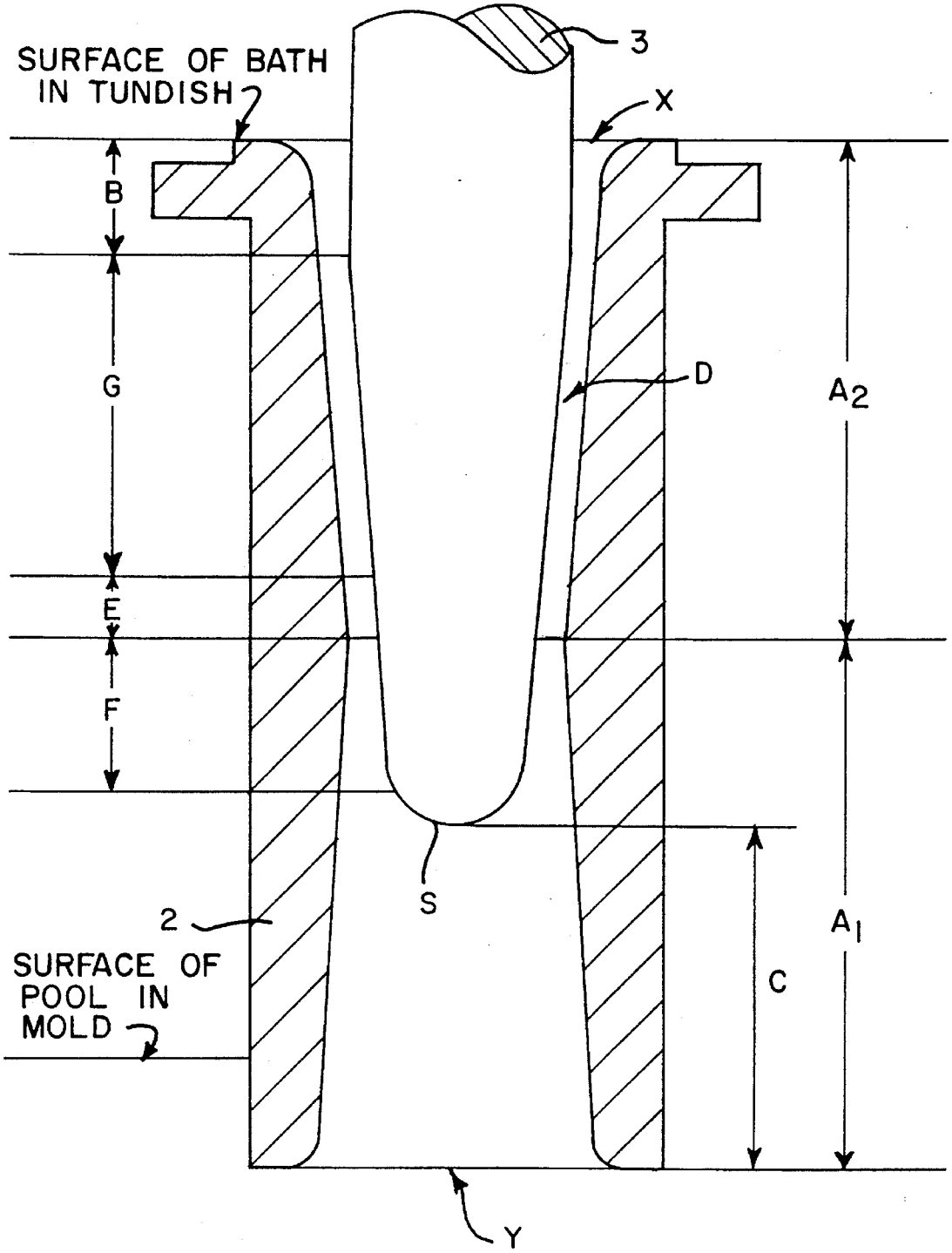
FIG. 2 is a partly sectional view showing details of a casting nozzle and stopper rod forming part of the teeming arrangement of FIG. 1.

The shapes of the nozzle 2 and stopper rod 3 are illustrated in FIG. 2. The nozzle 2 has an inlet end X with an upwardly directed end face and an outlet end Y with a downwardly directed end face. The cross section of the nozzle 2 decreases from the inlet end X to the middle of the nozzle 2 and also decreases from the outlet end Y to the middle of the nozzle 2. Thus, the cross section of the nozzle 2 is a minimum at its middle. The larger cross sections of the inlet end X and outlet end Y relative to the other locations of the nozzle 2 cause the flow velocities at the inlet end X and the outlet end Y to be low.

The stopper rod 3 is designed to project into the nozzle 2. In the illustrated position of the stopper rod 3, the nozzle 2 and the stopper rod 3 cooperate to define an annular gap or flow path D. This position represents an open or unblocked condition of the nozzle 2 in which molten material is free to flow through the nozzle 2. The stopper rod 3 can be moved downward in FIG. 2 to a position in which it forms a seal with the middle of the nozzle 2. The nozzle 2 is then closed or blocked and molten material is unable to flow through the nozzle 2.

The annular gap D is designed in such a manner that a stream of molten material flowing through the nozzle 2 is uniformly distributed over the entire flow cross section of the nozzle 2. The gap D has an upstream section B which narrows in a direction from the inlet end X towards the outlet end Y so that a dynamic pressure is generated in a stream of molten material flowing through the nozzle 2.

The narrowing upstream gap section B extends from the upwardly directed end face of the nozzle 2 partway towards the middle of the nozzle 2. The length of the upstream gap section B is preferably no more than 10 cm.

The gap D has a second, nearly uniform section G of almost constant width immediately downstream of the narrowing section B. The second gap section G is almost, but not quite, uniform because, like the narrowing section B, the gap D narrows in a direction from the inlet end X towards the outlet end Y along the second gap section G. The taper of the nearly uniform gap section G is, however, relatively small, e.g., of the order of 1 degree. The surface portions of the nozzle 2 and the stopper rod 3 which bound the nearly uniform gap section G are almost parallel to one another. Friction is generated in the nearly uniform gap section G and results in throttling of a molten stream flowing through the nozzle 2.

The nearly uniform gap section G extends from the upstream gap section B partway to the middle of the nozzle 2 and preferably has a length of 1 to 10 cm. Immediately downstream of the nearly uniform gap section G, the gap D has another section E which extends to the middle of the nozzle 2 and widens slightly in a direction from the inlet end X to the outlet end Y. This third gap section E widens inwards, that is, away from the internal surface of the nozzle 2, so that a molten stream flowing through the nozzle 2 makes better contact with the stopper rod 3.

As indicated previously, the nozzle 2 tapers inwards from the upwardly directed end face to the middle thereof. As a result, a molten stream flowing through the nozzle 2 becomes uniformly distributed over the flow cross section of the nozzle 2.

The gap D further has a downstream section F which extends from the middle of the nozzle 2 partway to the outlet end Y. The downstream gap section F again widens in a direction from the inlet end X towards the outlet end Y. The downstream gap section F widens in such a manner that a molten stream flowing through the nozzle 2 is decelerated without pulling away from the internal surface of the nozzle 2. The downstream gap section F preferably widens with an angle of divergence of at least 4 degrees.

To prevent a molten stream flowing through the nozzle 2 from pulling away from the stopper rod 3 in the region of the downstream gap section F, the tip S of the stopper rod 3 is rounded. It is preferred for the radius of the tip S to be in the range of 10 to 14 mm and such radius can, for instance, be 11.5 mm.

The distance A1 from the middle of the nozzle 2 to the downwardly directed end face of the nozzle 2, as well as the distance A2 from the middle of the nozzle 2 to the upwardly directed end face of the nozzle 2, is preferably at least 7 cm. Furthermore, it is preferred for the internal edges of the nozzle 2 at the outlet end X and the inlet end Y to be rounded. The radii of these internal edges advantageously lie in the range of 5 to 25 mm.

When the stopper rod 3 assumes a position in which the nozzle 2 is unblocked and molten material is teemed from the tundish 1 into the mold 5 via the nozzle 2, a pool of molten material is formed in the mold 5. The nozzle 2 is preferably positioned in such a manner that it projects into the molten pool to a depth of at least 2 cm. Moreover, the depth H of the molten bath in the tundish 1 is advantageously maintained at a minimum value of 5 cm. It is further preferred for the tip S of the stopper rod 3 to be spaced from the downwardly directed end face of the nozzle 2 by a distance C of at least 2 cm.

To check the actual flow characteristics in a teeming arrangement according to the invention, a water model was created to illustrate the situation arising during the production of a rolling ingot. This water model made it possible to simulate the conditions in the tundish, the nozzle and the rolling ingot with different nozzle-stopper rod combinations. The pressure characteristics in the teeming arrangement of the invention were investigated using the water model and the results are illustrated in FIG. 3.

Figure 3:
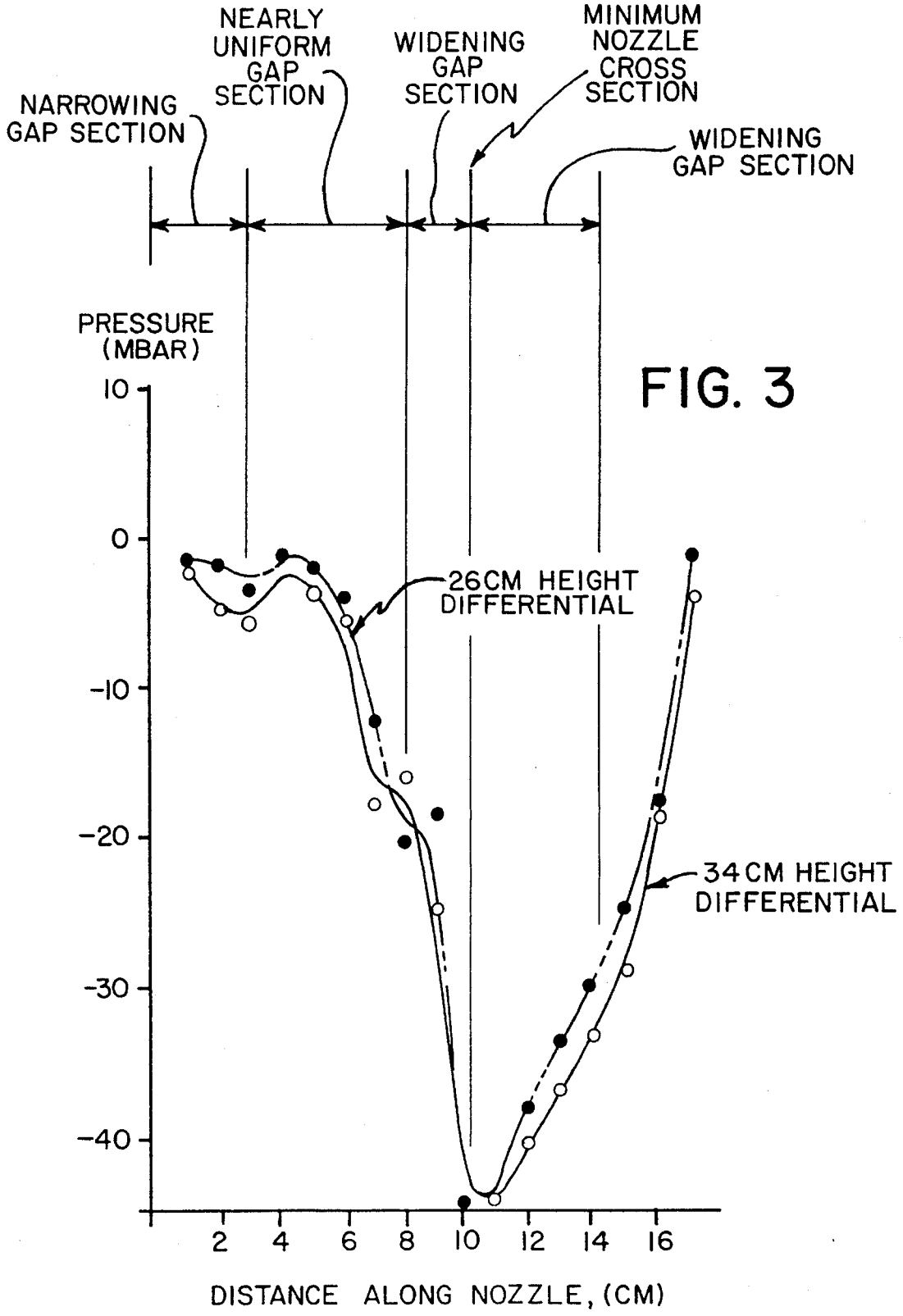
FIG. 3 is a plot illustrating the pressure distribution in a teeming arrangement according to the invention, the plot being based on a water model.

FIG. 3 is a plot of pressure versus distance along a nozzle. At the inlet end of the nozzle, that is, at zero distance, the pressure is positive or slightly negative. Due to the high flow velocities in the middle of the nozzle, a very large subatmospheric pressure is obtained. The large subatmospheric pressure in the region of the narrowest location of the nozzle indicates that the molten stream does not pull away from the surrounding surfaces. Downstream of the narrowest location, the magnitude of the subatmospheric pressure drops off very rapidly so that only a very small subatmospheric pressure exists at the outlet end of the nozzle, i.e., at a distance of approximately 17 cm.

Two curves are shown in FIG. 3 and correspond to different distances between the surface of the bath in the tundish and the surface of the pool in the mold. In the Example of FIG. 3, these distances were 26 and 34 cm. It is seen that the pressure characteristics barely changed with an increase in distance between the molten surfaces. The closely matching curves indicate that the flow conditions are very stable and that the molten stream in the nozzle does not pull away from the surrounding surfaces even at large subatmospheric pressures. It follows that the molten stream travels through the available flow cross section relatively uniformly and that no velocity peaks arise.

Figure 4A:
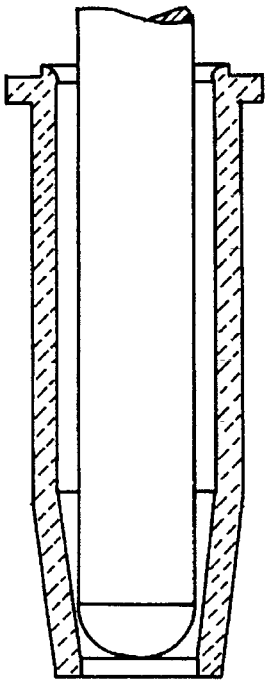
FIG. 4a PRIOR ART
FIG. 4*a* is a partly sectional view of one embodiment of a casting nozzle and stopper rod in accordance with the prior art.
Figure 5A:
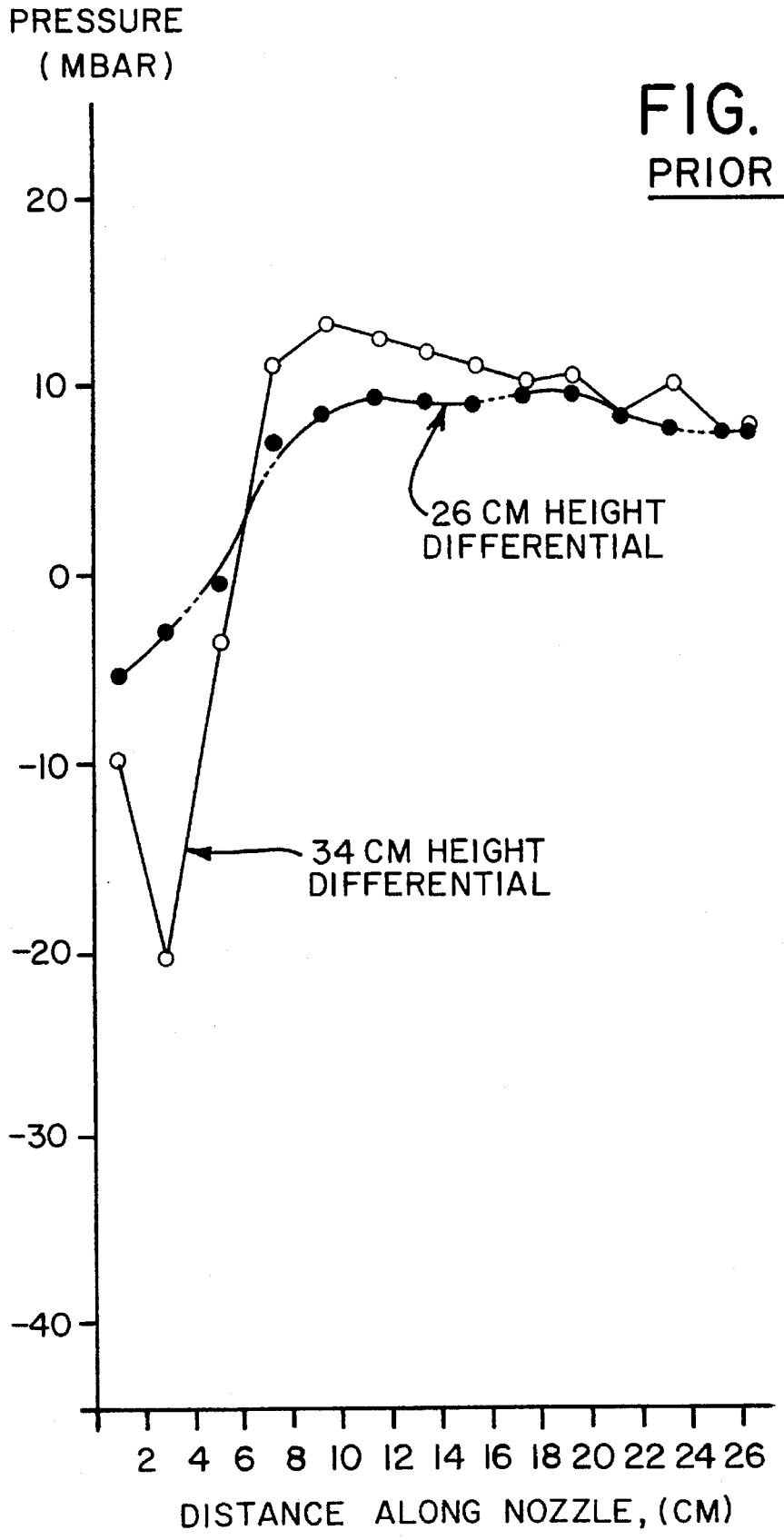
FIG. 5a PRIOR ART
FIG. 5*a* is a plot illustrating the pressure distribution in a prior art teeming arrangement using the casting nozzle and stopper rod of FIG. 4*a;*

FIG. 4*a* shows a prior art casting nozzle and stopper rod of the type in which the stopper rod establishes a seal with the nozzle at the bottom of the nozzle. Examples of the pressure characteristics of this casting nozzle-stopper rod combination are illustrated in FIG. 5*a* for the same two height differentials between the tundish bath surface and the mold pool surface as in FIG. 3. FIG. 5*a*, which is similar to FIG. 3, shows that the subatmospheric pressure at the nozzle outlet end is present in the major part of the nozzle. The reason is that the available flow cross section at the nozzle outlet end is greatly reduced because the molten stream pulls away from the surrounding surfaces. This results in large underpressures which cannot be compensated for by increasing the depth of immersion of the nozzle in the molten pool of the mold.

Figure 4B:
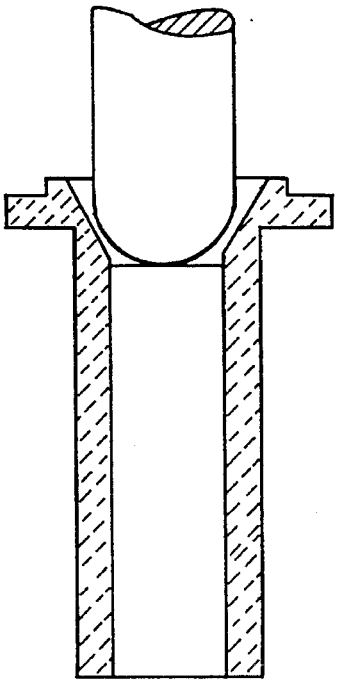
FIG. 4b PRIOR ART
FIG. 4*b* is similar to FIG. 4*a* but shows another embodiment of a prior art casting nozzle and stopper rod.
Figure 5B:
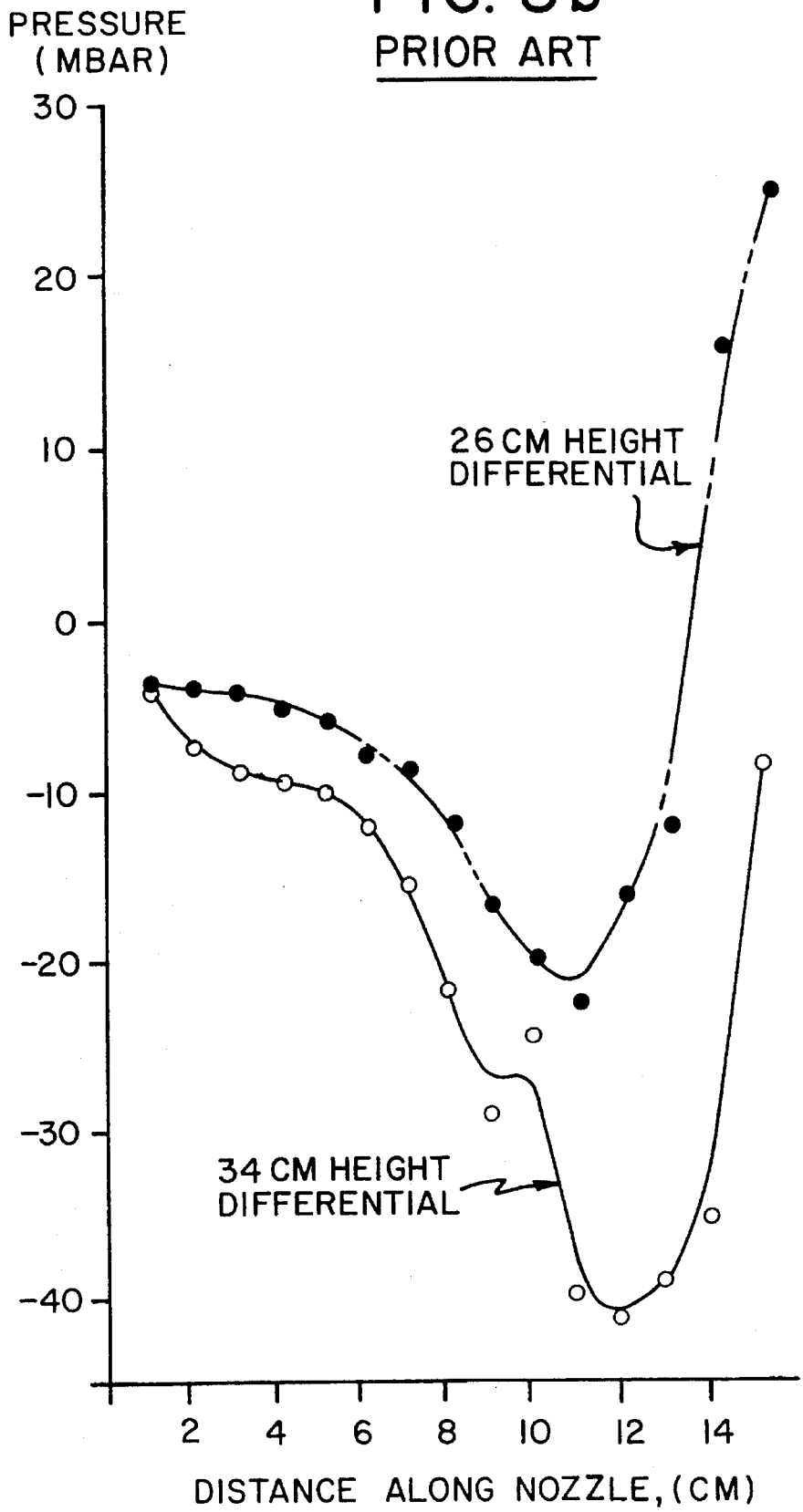
FIG. 5b PRIOR ART
FIG. 5*b* is similar to FIG. 5*a* but shows the pressure distribution in a prior art teeming arrangement using the casting nozzle and stopper rod of FIG. 4*b;*

FIG. 4*b* shows a prior art casting nozzle and stopper rod of the type in which the stopper rod seals the nozzle at the top of the nozzle. Pressure characteristics of this casting nozzle-stopper rod combination are illustrated in FIG. 5*b* for the same two height differentials between the tundish bath surface and the mold pool surface as in FIG. 3. As seen in FIG. 5*b*, which is similar to FIG. 3, the subatmospheric pressure increases greatly with increasing height differential. This indicates that the static pressure associated with the head of molten material above the nozzle inlet end in the tundish does not suffice to compensate for the subatmospheric pressure at the nozzle inlet end. Furthermore, below the stopper rod, the molten stream pulls away from the surrounding surfaces and reduces the available flow cross section. With greater height differentials, pulling away of the molten stream can occur all the way to the nozzle outlet end so that the subatmospheric pressure at the nozzle outlet end is increased leading to the drawbacks outlined previously.

The pressure characteristics employed for the preceding discussion depend upon the location of measurement. The illustrations in FIGS. 5*a* and 5*b* are two-dimensional and thus indicate nothing about the uniformity of flow peripherally of the casting nozzle. As explained earlier, nonuniformity can arise peripherally of the nozzle in conventional teeming arrangements. These can cause velocity peaks which, in turn, increase the subatmospheric pressure.

Moreover, in practice, the stopper rods are frequently tilted or bent thereby increasing the inhomogeneities. In conventional teeming arrangements, flow sometimes takes place over only half of the nozzle periphery. This causes problems in regulating the molten stream, and such problems become particularly noticeable in automatic mold level control systems.

The variation in nozzle cross section according to the invention allows a molten stream to be much more precisely controlled and makes it possible to reduce or eliminate inhomogeneities. A glass model showed that flow takes place relatively uniformly about the periphery of a nozzle in accordance with the invention.

Figure 6:
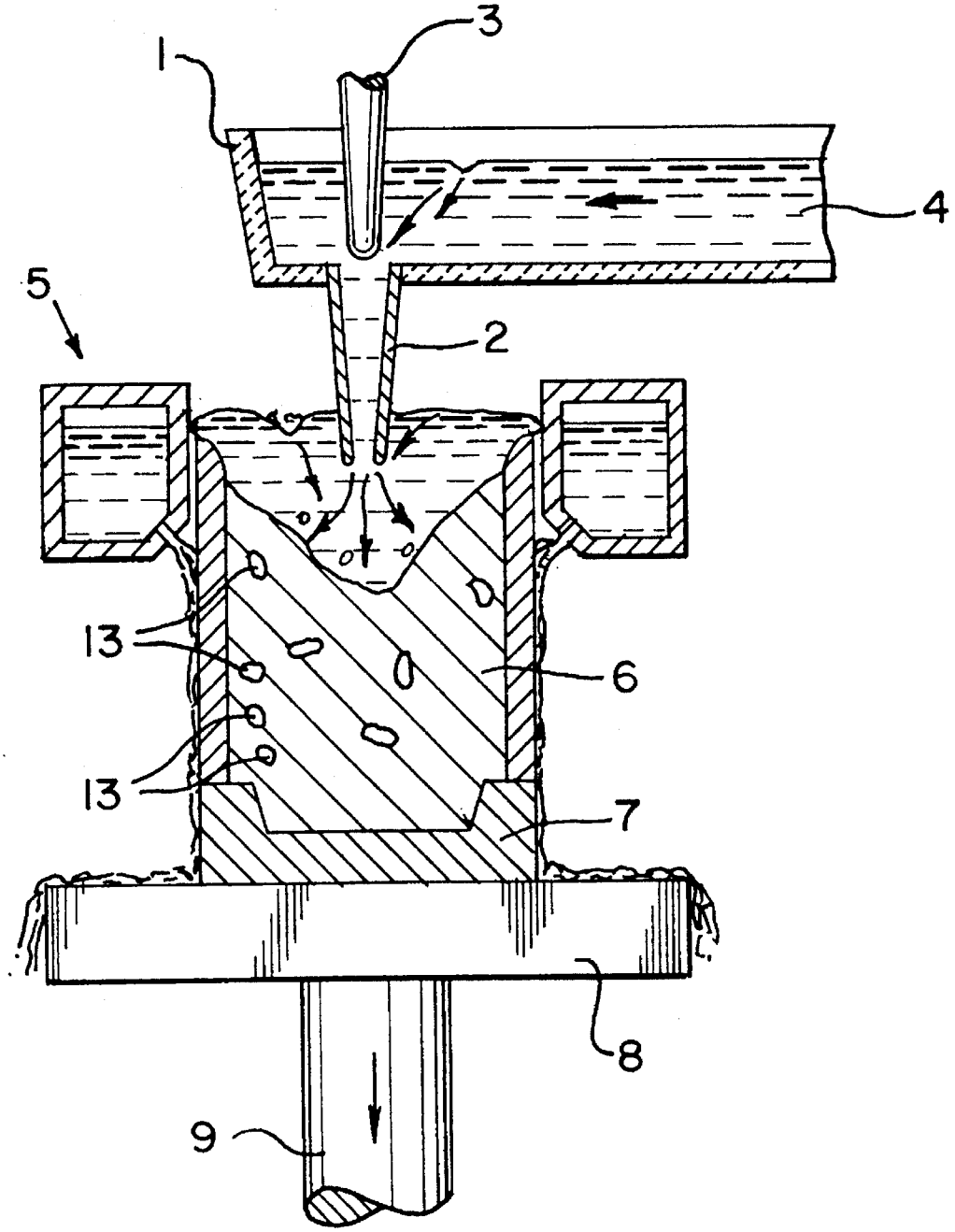
FIG. 6 PRIOR ART
FIG. 6 is a sectional view of a prior art teeming arrangement as applied to an apparatus for the continuous casting of aluminum-containing materials.

In contrast, conventional teeming arrangements tend to cause turbulence. This is illustrated in, and explained with reference to, FIG. 6. Molten material flows through the tundish 1 to the casting nozzle 2 in the direction of the arrow in the tundish 1. Due to the subatmospheric pressures occurring at the nozzle inlet end and the nozzle outlet end, indentations are formed in the surfaces of the tundish bath and mold pool by the pressure of the atmosphere. This allows the oxide layer to tear so that oxide and/or dirt particles can be sucked into the molten material. Impurities of this type which cannot be deformed are incorporated in the solidification front as indicated an 13. During subsequent rolling, they arrive at the surface and cause tearing of the rolled product or damage to the rollers.

Figure 7:
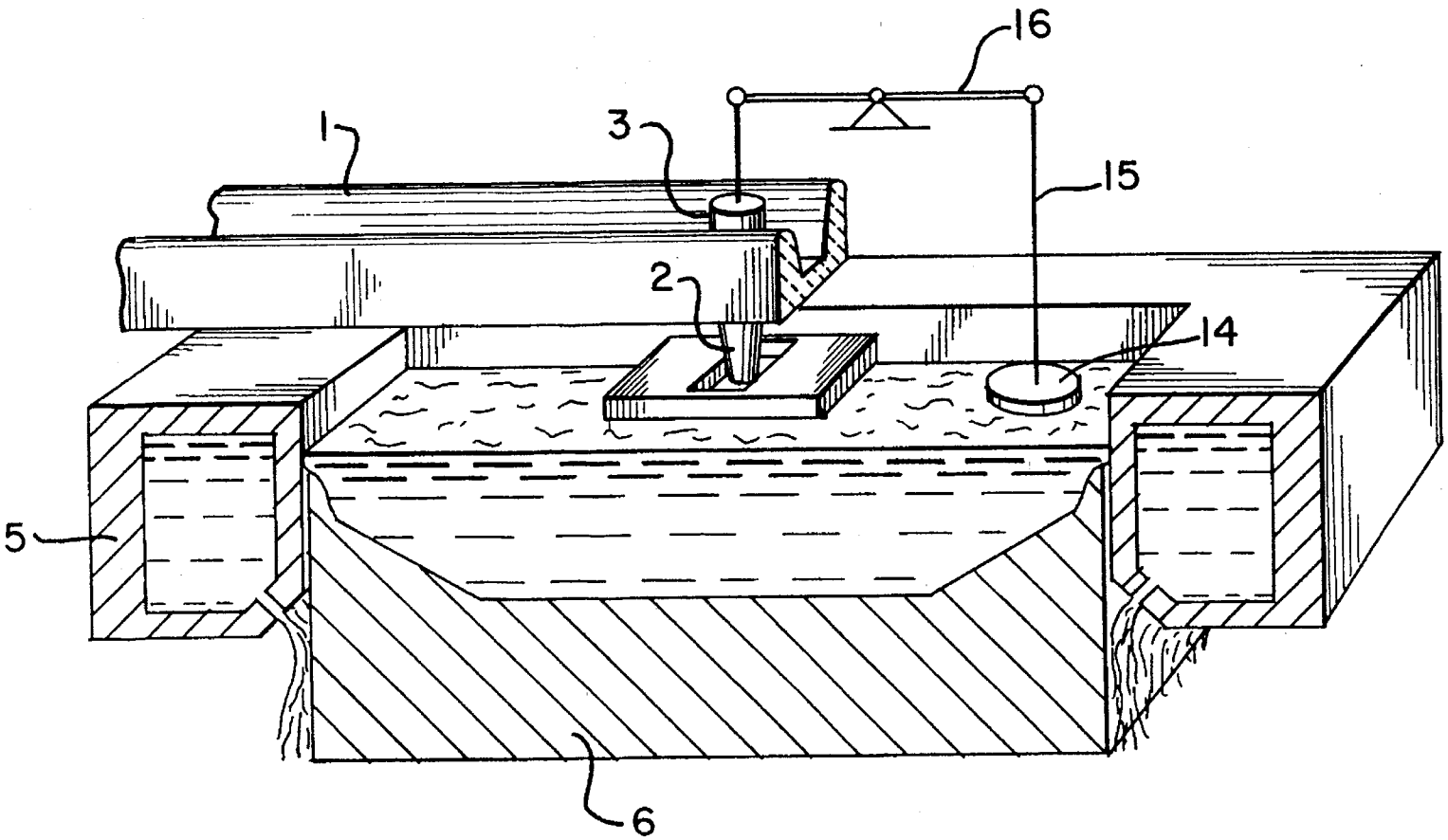
FIG. 7 is a partly sectional perspective view showing a mechanical mold level control system.

FIG. 7 schematically illustrates a mechanical mold level control system for aluminum-containing rolling ingots. A float 14 is disposed on the surface of the molten pool in the mold 5. The term "float" here means a body of refractory material which floats on the surface of the pool and indicates the level of the pool via a lever. The float 14 acts on a mechanical linkage 15 which moves the stopper rod 3 up-and-down through the agency of a rod 16. Depending upon the sense in which the level of the molten pool deviates from a reference level, the annular gap between nozzle 2 and stopper rod 3 is increased or decreased by movement of the stopper rod 3. The amount of molten material flowing through the nozzle 2 is thus regulated by adjusting the height of the stopper rod 3.

Figure 8:
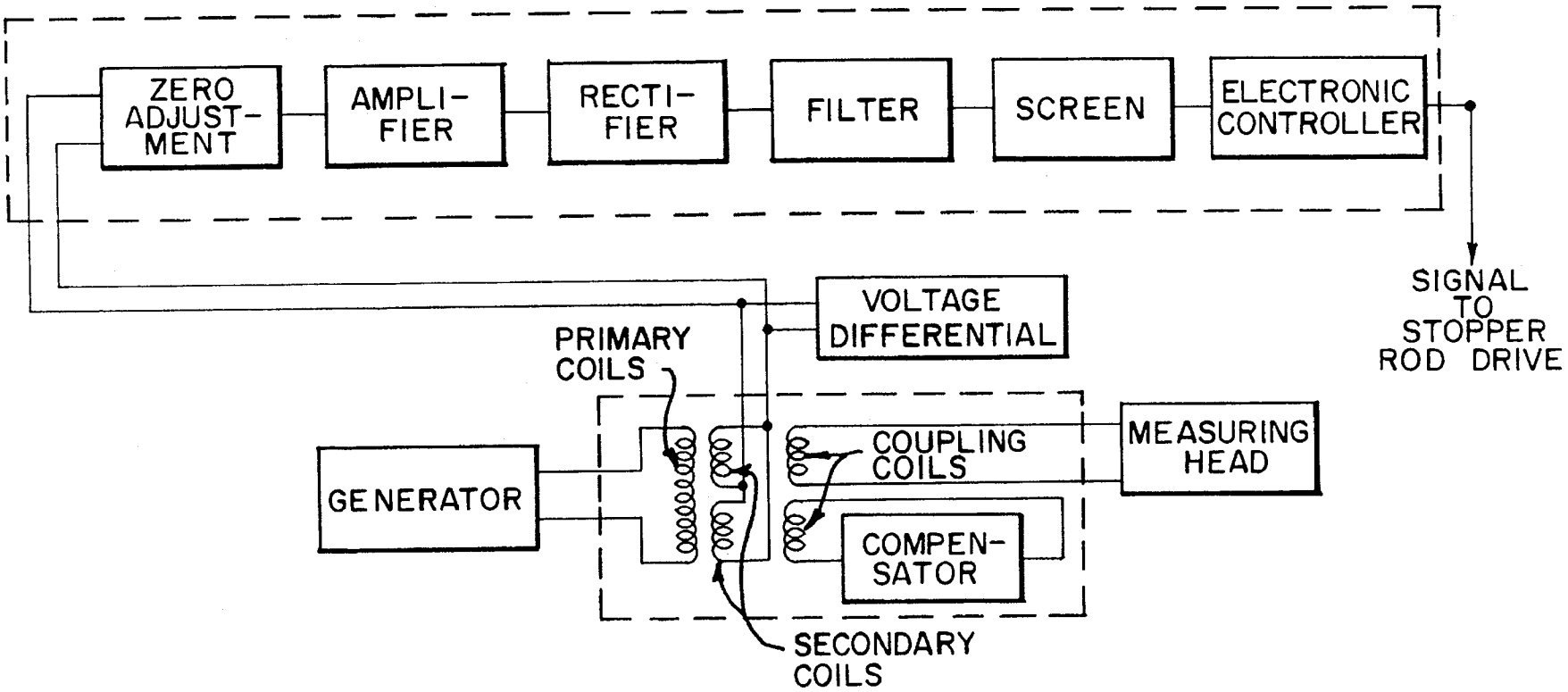
FIG. 8 is a block diagram of an electronic mold level control system.

Another method of mold level control resides in the use of a laser to sense the height of the molten pool in the mold. The laser generates a signal which is processed electronically and converted to an adjustment value for the stopper rod 3. Such processing and conversion may be accomplished using a circuit of the type shown in FIG. 8.

The mold level can fluctuate for various reasons. For instance, the tilt of the melting furnace may not be constant thereby causing the formation of a wave in the tundish. The tundish level is generally also controlled with a float so that two control systems are normally coupled to one another. This results in dynamic control behavior which requires continuous adjustment of the stopper rod height during casting.

Fluctuations in level change the thermal conditions, and this adversely affects the formation of the billet surface. Consequently, the thickness of the layer which must be completely removed prior to rolling is increased.

I claim:

1. A teeming arrangement for a continuous casting apparatus, particularly an apparatus for aluminum-containing materials, comprising a temporary holding vessel for a molten substance; a tubular member for discharging the molten substance from said vessel, said tubular member having an inlet end with a first end face, an outlet end with a second end face, and a location between said end faces at which the cross section of said tubular member is a minimum; and a valve member movable between a first position in which said tubular member is open and a second position in which said tubular member is closed, said tubular member and said valve member defining a gap in said first position, and said gap having an upstream section which extends from said first end face for a predetermined distance along said tubular member and narrows in downstream direction, the distance between said location and each of said end faces being at least 7 cm, said valve member having an end surface which is designed to face said outlet end, and said end surface being spaced from said second end face by at least 2 cm in said first position.

2. The arrangement of claim 1, wherein said valve member seals said location in said second position.

3. The arrangement of claim 1, wherein said predetermined distance is at most about 10 cm.

4. The arrangement of claim 1, wherein said valve member has a rounded end which is designed to face said outlet end, said rounded end having a radius of about 10 to 14 mm.

5. The arrangement of claim 1, wherein said inlet and outlet ends have internal edges, at least one of said edges being rounded and having a radius of about 5 to 25 mm.

6. The arrangement of claim 1 wherein said tubular member extends into a mold and the molten substance forms a bath in the mold, further comprising means for maintaining the height of the molten substance in said vessel at a minimum of about 5 cm and maintaining the bath in the mold at a height such that said tubular member projects into the bath for a minimum distance of about 2 cm.

7. The arrangement of claim 1, wherein said upstream section terminates upstream of said location.

8. The arrangement of claim 4, wherein said upstream section is annular.

9. The arrangement of claim 1, wherein said gap has another section downstream of said location which widens in downstream direction.

10. The arrangement of claim 9, wherein said other section widens with an angle of divergence of at least 4 degrees.

11. The arrangement of claim 1, wherein said gap has another section downstream of said upstream section, said gap narrowing along said other section in downstream direction.

12. The arrangement of claim 11, wherein said other section has a length of about 1 cm to about 10 cm.

13. The arrangement of claim 11, wherein said other section is substantially annular.

14. The arrangement of claim 11, wherein said gap narrows along said other section with an angle of convergence of about 1 degree.

* * * * *